US011432669B2

(12) United States Patent
O'Malley et al.

(10) Patent No.: US 11,432,669 B2
(45) Date of Patent: Sep. 6, 2022

(54) ASSISTANCE DEVICE FOR PUTTING ON JACKET

(71) Applicants: Katherine Grace O'Malley, West Chester, PA (US); Ravi Mukul Gandhi, Matawan, NJ (US); Zachary Regis Ritchey, Schwenksville, PA (US); Robert Jordan Morris, III, Lincoln University, PA (US)

(72) Inventors: Katherine Grace O'Malley, West Chester, PA (US); Ravi Mukul Gandhi, Matawan, NJ (US); Zachary Regis Ritchey, Schwenksville, PA (US); Robert Jordan Morris, III, Lincoln University, PA (US)

(73) Assignee: Reachable Solutions Inc., Matawan, NJ (US)

( * ) Notice: Subject to any disclaimer, the term of this patent is extended or adjusted under 35 U.S.C. 154(b) by 0 days.

(21) Appl. No.: 16/386,011

(22) Filed: Apr. 16, 2019

(65) Prior Publication Data

US 2021/0068571 A1 Mar. 11, 2021

(51) Int. Cl.
*A47G 25/90* (2006.01)

(52) U.S. Cl.
CPC ..... *A47G 25/90* (2013.01)

(58) Field of Classification Search
CPC ..... A47G 25/90
USPC ..... 223/11
See application file for complete search history.

(56) References Cited

U.S. PATENT DOCUMENTS 3,384,408 A * 5/1968 Denis ..... B25B 11/002 294/65.5
2010/0200622 A1 8/2010 Fusaro
2014/0088338 A1* 3/2014 Chang ..... A43B 1/0045 600/15

(Continued)

FOREIGN PATENT DOCUMENTS

EP 1358829 A1 4/2003
JP 3182255 U 3/2013

OTHER PUBLICATIONS

Amazon Listing for Telescopic Magnetic Pickup Tool first available on Jan. 1, 2018 as indicated on p. 3 of 8, retrieved by Examiner at https://www.amazon.com/VASTOOLS-Telescopic-Magnetic-Pickup-Extendable/dp/B073PBR5PL/ref=sr_1_1_sspa?dchild=1&keywords=magnet+grabber&qid on Mar. 24, 2021. (Year: 2018).*

(Continued)

*Primary Examiner* — F Griffin Hall

(57) ABSTRACT

An assistance device for putting on a jacket includes an elongated bar and magnetic connection elements (such as magnets or metallic elements) positioned at each end of the elongated bar. The assistance device can be magnetically attached to corresponding magnetic connection elements at the shoulders of a jacket. As the jacket is placed over one shoulder, the other end of the assistance device (and attached portions of the jacket) will tend to be biased toward the other side of the user. This makes it easier for users to grab the other side of the jacket since it extends toward the arm not in the jacket sleeve reducing the distance that the user needs to move this arm behind their back to grab the jacket. This is especially valuable for users with restricted mobility who find it hard to put on jackets without the assistance device.

6 Claims, 5 Drawing Sheets

(56) References Cited

U.S. PATENT DOCUMENTS

2016/0278460 A1* 9/2016 Hunter ..... A41F 1/002

OTHER PUBLICATIONS

Frigits listing dated Dec. 14, 2006 retrieved by Examiner at http://www.superdairyboy.com/Toys/frigits.html on Mar. 24, 2021 (Year: 2006).*

The Universe Today Article published by Tega Jessa on Sep. 16, 2010 and retrieved by the Examiner at https://www.universetoday.com/73723/what-are-magnets-made-of/on Sep. 3, 2021 (Year: 2010).*

* cited by examiner

ASSISTANCE DEVICE FOR PUTTING ON JACKET

FIELD OF INVENTION

The invention relates generally to assistance devices to aid users with restricted mobility to put on clothing, such as jackets.

BACKGROUND

People with restricted mobility may have difficulties putting on jackets. Typically, when one shoulder of a jacket is put on, the other shoulder of the jacket will drape down below that shoulder. Users will then reach behind their back to grab the jacket with the arm not in a jacket sleeve. This can be difficult for users with restricted mobility, such as that resulting from age, injury, or other conditions that limit the flexibility of the arms and/or the ability to grasp.

SUMMARY

Embodiments describe an assistance device for putting on a jacket as well as a method for using the assistance device to put on the jacket.

The assistance device can include an elongated bar and magnetic connection elements (such as magnets or metallic elements) positioned at each end of the elongated bar. The assistance device can be magnetically attached to corresponding magnetic connection elements at the shoulders of a jacket.

After the assistance device is magnetically attached to the corresponding magnetic connection elements at the shoulders of a jacket, the user will put on one of the shoulders of the jacket. The inventors have found that as the jacket is placed over one shoulder, the other end of the assistance device (and attached portions of the jacket) will tend to be biased toward the other side of the user. This makes it easier for users to grab the other side of the jacket since it extends toward the arm not in the jacket sleeve reducing the distance that the user needs to move this arm behind their back to grab the jacket. This is especially valuable for users with restricted mobility who find it hard to put on jackets without the assistance device.

In one embodiment, the distance between the magnetic connection elements on the elongated bar may be designed to be shorter than the fully extended distance between the corresponding magnetic connection elements in the jacket so that when the magnetic connection elements of the elongated bar magnetically engage with the corresponding magnetic connection elements of the jacket, the fabric of the jacket between the corresponding magnetic connection elements is slack. When the jacket is put on both shoulders, the fabric of the jacket will become taut and a shear force will be created which will cause one of the magnetic connection elements of the bar to magnetically disengage from a corresponding magnetic connection element of the jacket.

In one embodiment, the assistance device can be collapsible to make it more portable. For example, a collapsible assistance device can be telescoped, fold-able, or use sections that slide apart.

DETAILED DESCRIPTION

Figure 1:
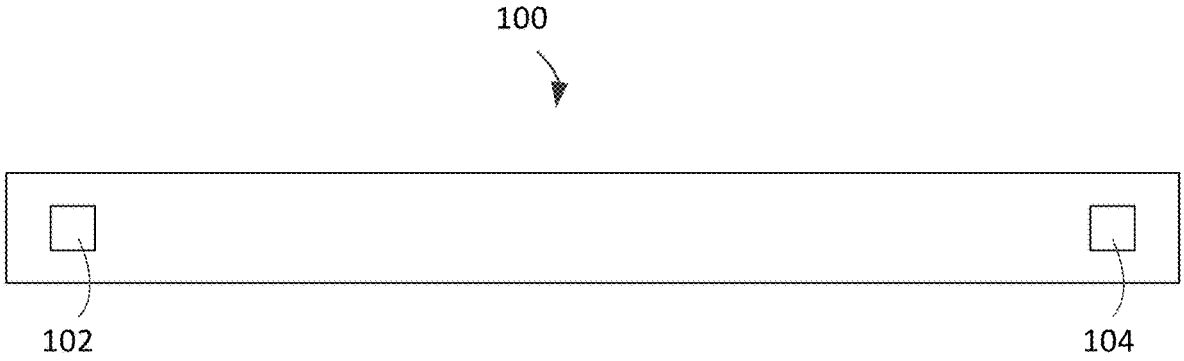
FIG. 1 shows an illustration of an assistance device for putting on a jacket in accordance with one embodiment.

FIG. 1 shows an assistance device 100 for putting on a jacket. The assistance device 100 includes magnetic connection elements 102 and 104 and elongated bar 106. The magnetic connection elements 102 and 104 can be magnets or metallic elements which can connect to corresponding magnetic connection elements in a jacket.

The elongated bar 106 can be made of any material, such as wood, metal, or plastic. In an embodiment, the elongated bar 106 is stiff so as to resist bending or folding. The elongated bar 106 can be unitary or composed of multiple elements. In one embodiment described below, the elongated bar 106 is collapsible to aid in portability.

Figure 2:
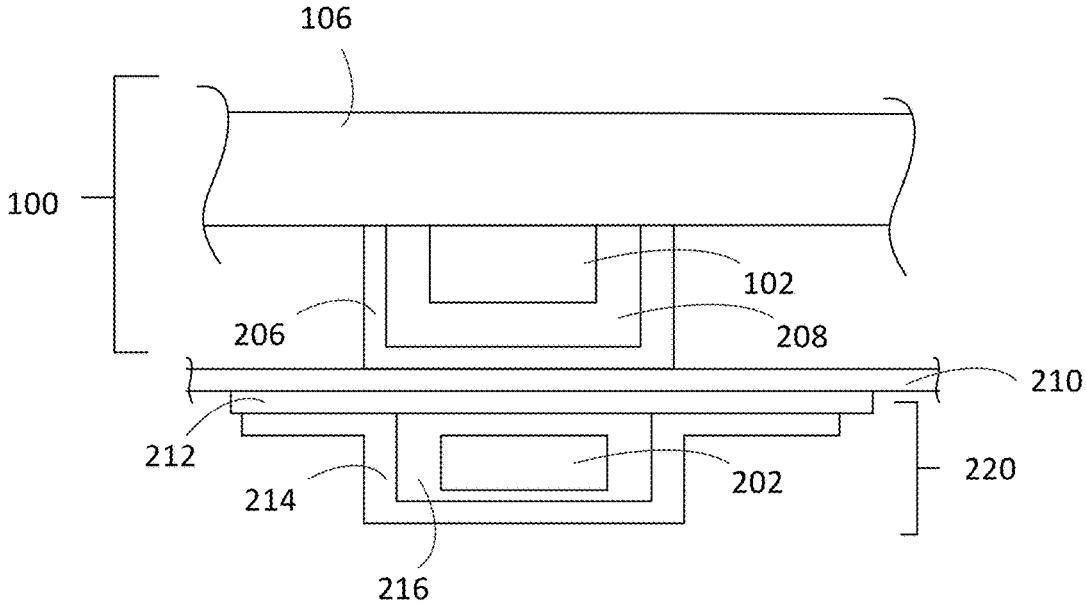
FIG. 2 shows a cross-sectional view of magnetic connection element on an assistance device in magnetic engagement with corresponding magnetic connection element in a jacket.

FIG. 2 shows a cross-sectional view of magnetic connection element 102 on elongated bar 106 of assistance device 100 in magnetic engagement with corresponding magnetic connection element 202 in jacket 204.

In one embodiment, the magnetic connection element 102 and corresponding magnetic connection element 202 are both be magnets. In another embodiment, one of the magnetic connection element 102 or the corresponding magnetic connection element 202 is a metal element and the other is a magnet. In this way, a magnetic engagement can be made between magnetic connection element 102 and corresponding magnetic connection element 202 when they are close together. In one embodiment, the magnet is a permanent magnet such as a neodymium magnet, a samarium-cobalt magnet, a ceramic magnet or an alnico magnet.

In one embodiment, the magnetic connection element 102 is covered by a covering material 206 such as tape, fabric, hardened glue, or plastic. This covering material 206 can aid in breaking the magnetic engagement using a shear force as described below. An optional protective material 208 such as foam can be used to minimize wear on the jacket and covering material 206. due to the disengagement of magnetic connection element 102 and corresponding magnetic connection element 202. It is believed that the edges of the magnetic connection element 102 and/or corresponding magnetic connection element 202 may tend to cause fabric damage in some cases during magnetic disengagement which may be prevented with the optional protective material 208.

FIG. 2 also shows jacket fabric 210, and a patch 220 including patch material layers 212 and 214 surrounding the corresponding magnetic connection element 202 and used to attach the corresponding magnetic connection element 202 to the jacket. The patch can also include an optional protective material 216, such as foam, that has a similar function as optional protective material 208 discussed above.

The patch 220 can be attached to the inside of the jacket. The attachment can be sewed on, attached with adhesive, or some other attachment method can be used. As an alternative to using a patch, the corresponding magnetic connection element 202 can be integrally formed into the jacket. In one embodiment, the assistance device 100 can be provided as part of a kit along with a jacket with the corresponding magnetic connection elements, or as part of a kit along with patches with the corresponding magnetic connection elements which are designed to be attached to the jacket.

Figure 3:
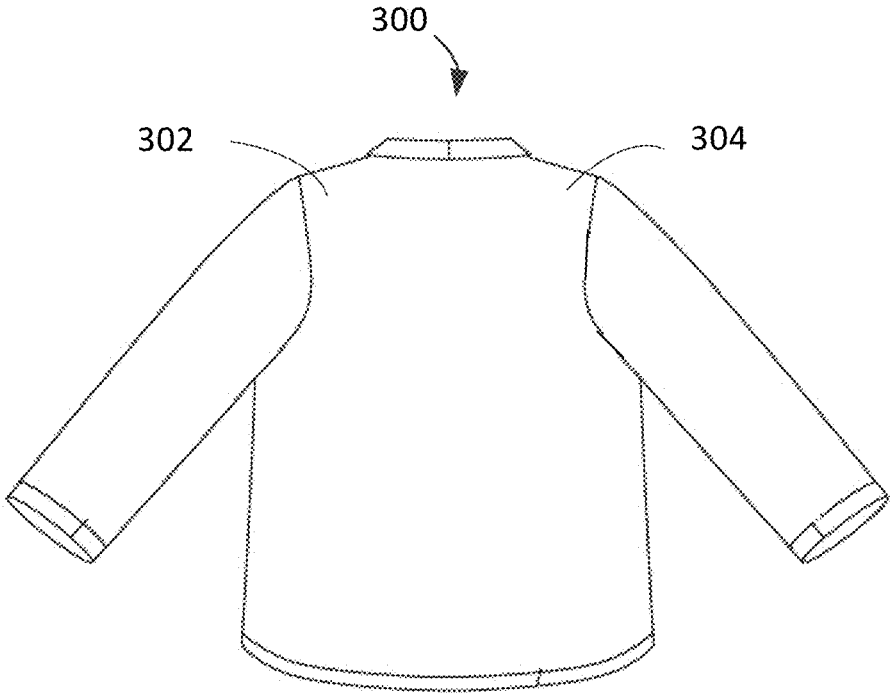
FIG. 3 shows a jacket with shoulder regions where the corresponding magnetic connection elements can be positioned.

FIG. 3 shows a jacket 300 with shoulder regions 302 and 304 where the corresponding magnetic connection elements can be positioned.

Figure 4:
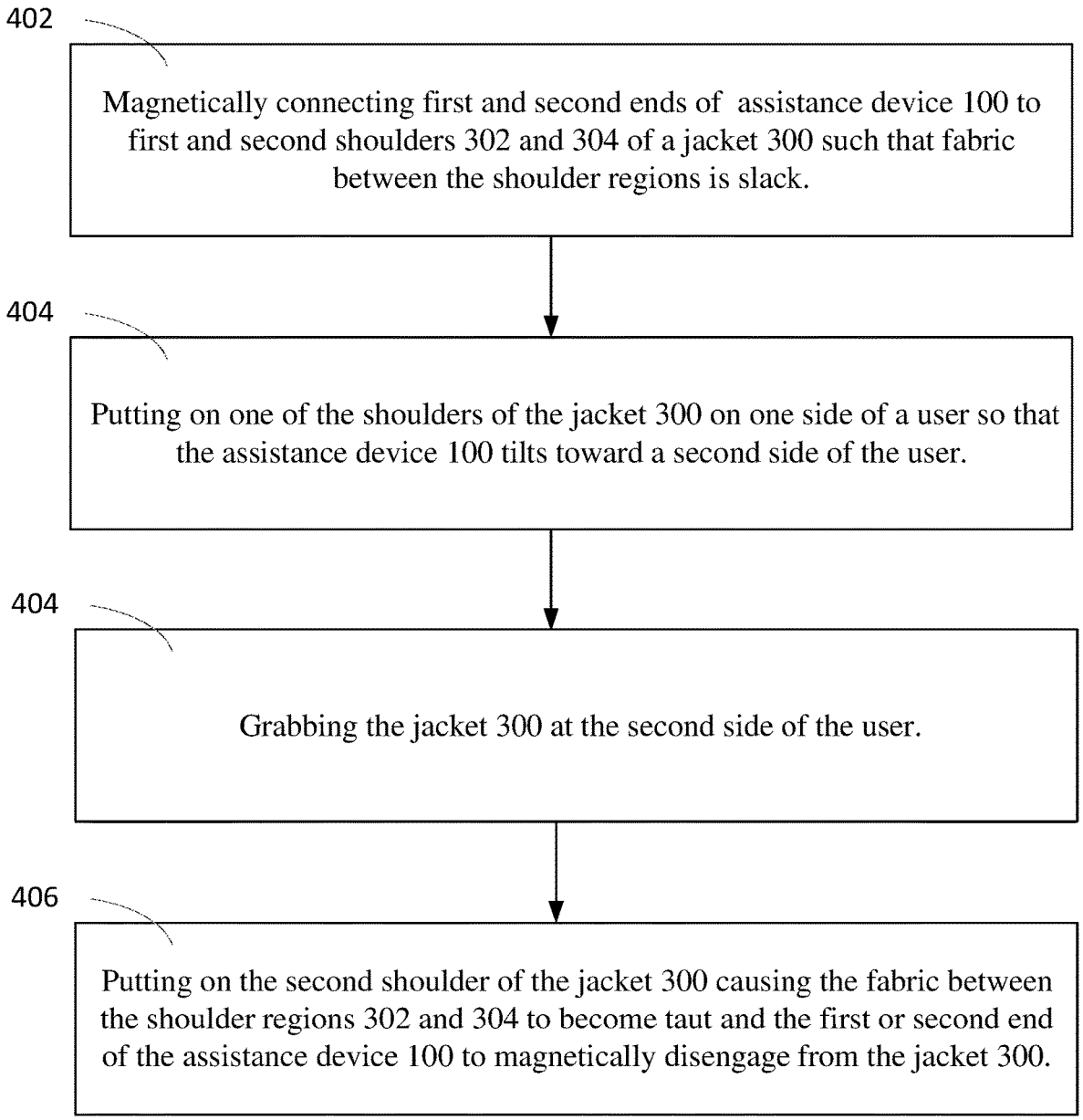
FIG. 4 shows flow chart of one embodiment.

FIG. 4 shows flow chart of one embodiment. In step 402, first and second ends of assistance device 100 is magnetically connected to shoulder regions 304 and 306 of a jacket 300. In one embodiment, the distance on the assistance device 100 between magnetic connection elements 102 and 104 is less than the distance between shoulder regions 304 and 306 on jacket 302. This will result in the fabric between the shoulder regions 304 and 306 being slack.

In step 402, a user puts on one of the shoulders of the jacket. The inventors have determined that this results in the assistance device 100 and the attached jacket 300 tilting or biasing toward the user's other side. This may be due to the connection of the assistance device 100 to shoulder regions 302 and 304 of a jacket 300 preventing the assistance device 100 from dropping directly below the shoulder under gravity. Gravity would then naturally cause the assistance device to pivot towards the user's back. Alternately or in combination, the user may naturally adjust the shoulder region of jacket while putting on that shoulder so as to move the weight of the assistance device 100 toward the user's center of mass to better support the weight of the assistance device 100 (similar to how a backpack supported by a single shoulder will naturally tilt). It is also possible that user's shoulder blade interacts with the bar 106 of the assistance device to cause or contribute to the tilt. In any event, the method and device does not depend on any specific explanation for this phenomenon.

In step 404, the user can grab the jacket at using their free arm. This will be easier than grabbing a jacket that has draped directly below the shoulder, especially for users with reduced mobility.

In step 406, the user puts on the second shoulder of the jacket. This will cause the fabric between the shoulder regions 302 and 304 to become taut and one of the ends of the assistance device to magnetically disengage from the jacket due to the shear forces on the ends of the assistance device 100.

Typically, magnets are much easier to to pull apart in shear. The required shear force to separate the magnetic connection regions can be as low as 10% or lower of the required normal force to separate the magnetic connection regions due to properties of the covering material 206 and the jacket fabric 210. Resistance in shear is proportional to the coefficient of friction between the contacting materials. If the perpendicular (or normal) force required to pull apart magnets is N, then the required shear force required to pull apart magnets is $\mu N$, with $\mu$ being the coefficient of friction. The covering material 206 can be selected to be relatively smooth so that the resulting coefficient of friction between the covering material 206 and jacket fabric 210 is low.

Typically, one of the connection points will start to separate first, weakening the magnetic connection at that connection point while the magnetic connection at the other connection point remains intact. This will result in the assistance device 100 becoming fully disengaged from one connection point while remaining attached to the other.

The assistance device 100 will then tend to rotate under the force of gravity to the user's side and can be removed by pulling down on the assistance device. Pulling down on the assistance device 100 will produce a shear force such that assistance device 100 can be easily removed.

The assistance device 100 can be collapsible for portability with the assistance device 100 being expanded before use and collapsed after use. For example, the bar can be telescoped, foldable, or use sections that slide apart.

Figure 5:
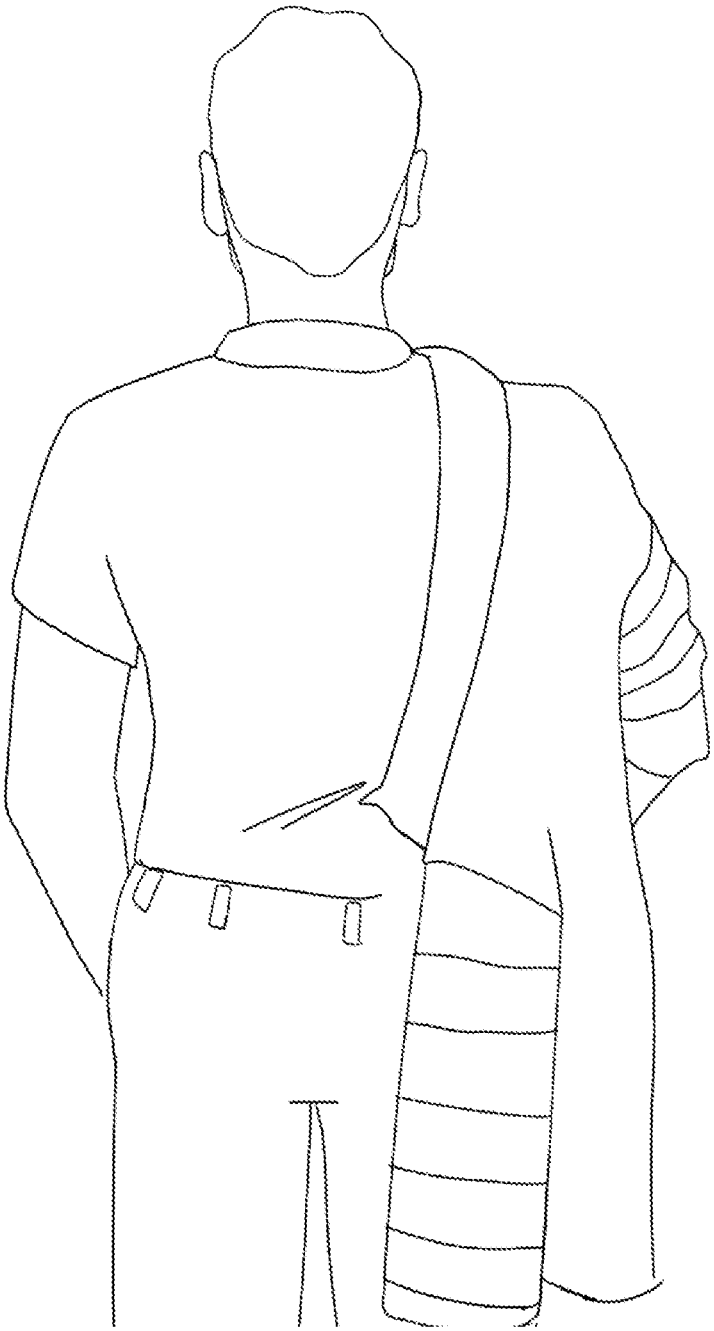
FIG. 5 is an illustration of a user putting on a jacket without the assistance device.

FIG. 5 is an illustration of a user putting on a jacket without the assistance device. As shown, when the user has one arm in the jacket, the jacket naturally drapes down below the shoulder of that arm making it hard for the user to grab the jacket.

Figure 6:
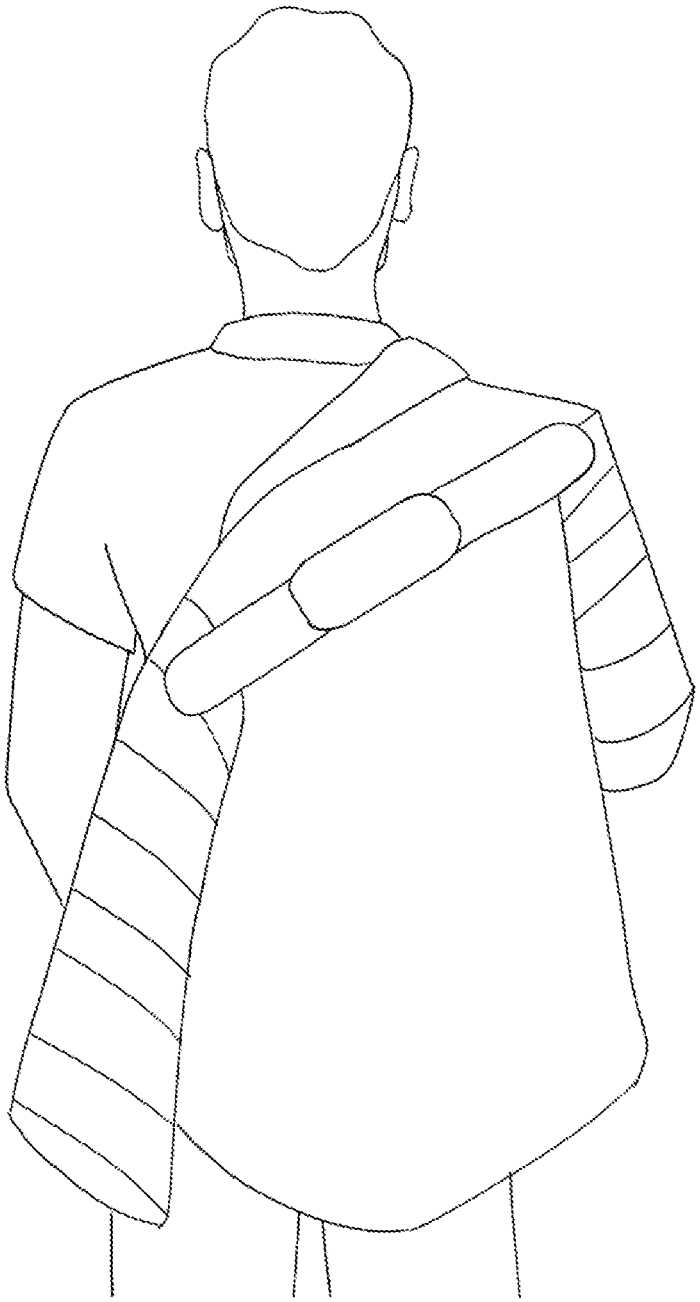
FIG. 6 is an illustration of a user putting on a jacket with the assistance device.

FIG. 6 is an illustration of a user putting on a jacket with the assistance device. As shown, when the user has one arm in the jacket connected to the assistance device, the jacket naturally tilts toward the other side of the user making it easier for the user to grab the jacket.

The foregoing description of the present invention has been provided for the purposes of illustration and description. It is not intended to be exhaustive or to limit the invention to the precise forms disclosed. Many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A method comprising:

magnetically connecting first and second ends of an assistance device to first and second shoulders of a jacket such that fabric between the first and second shoulders of the jacket is slack;

putting on one of the shoulders of the jacket on one side of a user so that the assistance device tilts toward a second side of the user;

grabbing the jacket at the second side of the user; and putting on the second shoulder of the jacket causing the fabric between the first and second shoulders of the jacket to become taut and the first or second end of the assistance device to magnetically disengage from the jacket.

2. The method of claim 1, wherein the assistance device includes an elongated bar and magnetic connection elements positioned at each end of the elongated bar wherein the magnetic connection elements are spaced on the elongated bar such that they are able to magnetically engage with corresponding magnetic connection elements in the jacket.

3. The method of claim 1, further comprising removing the assistance device from a shoulder of the jacket that had remained connected to the assistance device after the assistance device has swung downward under the force of gravity.

4. The method of claim 1, wherein when the fabric between the first and second shoulders of the jacket becomes taut a shear force is put onto the magnetic connection.

5. The method of claim 1, wherein the assistance device is collapsible, further comprising expanding the assistance device before the magnetically connecting step.

6. The method of claim 1, wherein the assistance device is collapsible, further comprising contracting the assistance device after the assistance device is removed from the jacket.

* * * * *